US006076497A

United States Patent [19]

Ferralli

[11] Patent Number: 6,076,497

[45] **Date of Patent: *Jun. 20, 2000**

[54] PRESSURIZED CONTAINERS USING PHASE CHANGE SYSTEM

[75] Inventor: Michael W. Ferralli, Fairview, Pa.

[73] Assignee: Technology Licensing Company, Pittsburgh, Pa.

[ * ] Notice: This patent is subject to a terminal disclaimer.

[21] Appl. No.: 09/014,907

[22] Filed: Jan. 28, 1998

Related U.S. Application Data

[63] Continuation-in-part of application No. 08/907,228, Aug. 6, 1997.

[51] Int. Cl.[7] ..... F01M 5/00

[52] U.S. Cl. ..... 123/196 S; 184/6.3

[58] Field of Search ..... 123/196 R, 196 S; 184/6.4, 6.3, 107; 138/30; 222/256, 261, 263

[56] References Cited

U.S. PATENT DOCUMENTS

| | | | |
|---|---|---|---|
| 2,747,564 | 5/1956 | Wehling | 123/196 S |
| 2,755,787 | 7/1956 | Butler et al. | 123/196 S |
| 4,094,293 | 6/1978 | Evans | 123/196 S |
| 4,109,831 | 8/1978 | Culpepper et al. | 227/254 |
| 4,367,786 | 1/1983 | Hafner et al. | 165/10 |
| 4,697,414 | 10/1987 | Malarty | 60/39.08 |
| 4,714,093 | 12/1987 | Kawano et al. | 138/30 |
| 5,069,177 | 12/1991 | Dokonal | 123/196 S |
| 5,156,120 | 10/1992 | Kent | 123/196 S |
| 5,197,424 | 3/1993 | Blum | 123/196 S |
| 5,488,935 | 2/1996 | Berry, Jr. | 123/196 S |
| 5,494,012 | 2/1996 | Hager | 123/196 S |
| 5,497,852 | 3/1996 | Little et al. | 184/7.4 |

*Primary Examiner*—Noah P. Kamen
*Assistant Examiner*—Hai Huynh
*Attorney, Agent, or Firm*—Cohen & Grigsby, P.C.

[57] ABSTRACT

The present invention relates to a method of providing nearly constant pressure during operation of a device incorporating a pressurized container and more particularly pre-ignition lubrication mechanisms for internal combustion engines, pressurized pre-combustion oiling mechanism for use with internal combustion engines, pressurized water or other fluid tanks, and pressurized fluid and other pressurized material dispensers. The present invention provides an accumulator tank containing either air or an easily condensed gas. The pressurized oil causes the air or gas in the bag to become compressed, causing a decrease in occupied volume in proportion to the pressure induced by the oil to allow the oil to occupy a suitable portion of the tank. In the preferred embodiment of the invention, the pressurized oil would cause the easily condensed gas to undergo a phase change and liquify. Conventional valving known in the state of the art is provided to allow the accumulated pressurized oil to be used prior to a subsequent engine startup, and conventional electronic control systems are provided to engage and disengage the aforementioned valves for a proper pre-ignition lubrication sequence. The present invention also provides a means of enhancing the volume of oil delivered by the accumulator.

39 Claims, 4 Drawing Sheets

PRESSURIZED CONTAINERS USING PHASE CHANGE SYSTEM

CROSS-REFERENCE

This application is a continuation-in-part (CIP) of U.S. patent application Ser. No. 08/907,228, filed Aug. 6, 1997 and entitled "Captive Bag Engine Pre-Oiling Apparatus".

FIELD OF THE INVENTION

The present invention relates to a method of providing nearly constant pressure during operation of a device incorporating a pressurized container and more particularly pre-ignition lubrication mechanisms for internal combustion engines, pressurized pre-combustion oiling mechanism for use with internal combustion engines, pressurized water or other fluid tanks, and pressurized fluid and other pressurized material dispensers.

BACKGROUND OF THE INVENTION

There are a great many devices which utilize tanks or containers which dispense fluids or other appropriate materials by use of pressurized gas. These devices include pressurized water storage tanks, fuel tanks, pressurized food and material dispensers, and a host of similar devices. The typical gases used in these containers include air, propane, and other gases. In operation all these gases provide the force necessary to expel the contents of the container. However, inherent in the use of pressurized gases in the container is the reduction in force applied to expel the contents of the container as the is depleted of its contents. This is due to the inherent properties of gas. In particular, the pressure with a well water storage tank, being pressurized with air typically is reduced from a pressure of 40 psi, when the tank is filled to maximum capacity with water, to a pressure of 20 psi when the tank is at minimum capacity and the water pump is activated.

In an other example, the bearing surfaces in internal combustion engines are subjected to relatively high loads because of the compression pressures necessary to effect combustion in these devices. The life expectancy of internal combustion engines has been found to depend significantly upon the high-wear status of the bearings under conditions of high loads and minimal lubrication found during startup. This dependency is often the cause for more frequent and expensive overhaul work to keep the engine in operation. During such overhauls, it has been regularly observed that the crankshaft bearings are exhausted long before expected, even though they were properly installed and the oil supply system was operating as designed.

A variety of approaches have been previously attempted to alleviate this problem, one such approach being exemplified by U.S. Pat. Nos. 3,583,525; 3,583,527; 3,722,623; 3,917,027; 4,061,204; 4,094,293; 4,112,910; 4,157,744; and 4,199,950. These patents generally teach that the problem relates to a lack of lubrication at start-up, and disclose systems having variously configured auxiliary oil accumulators which through appropriate valving bleed off and store a portion of the oil supply during normal engine operation and release it to the engine using pressurized air prior to or at the time of the next restart. Typically this pressuring gas is either not isolated from the oil supply or is isolated using ineffective and/or inefficient mechanisms such as pistons or partition membranes. Those accumulator-based approaches using air are limited by the large volumes of oil required to achieve normal operating oil pressures for the initiation of combustion, especially in the case of very large internal combustion engines which often require the pumping of up to five gallons of oil before normal operating oil pressures are attained. Because space is already at a premium in these very large engine compartments, it is often not desirable to include an auxiliary oil accumulator having a such a large volume. Further, the use of large volume pressurized air pre-oilers would tend to create large variations in the rate of and/or pressure of the oil supplied to the engine since the air pressure within the tank will decrease with increasing air volume.

Another approach is exemplified by U.S. Pat. Nos. 4,058,981 and 4,126,997, which disclose that inadequate start-up lubrication is the cause of the problem and teach a valve system which initially routes engine oil to more critical engine components such as the turbocharger and crankshaft bearings upon start-up, and thereafter to less critical engine components. This approach is beneficial, but since it does not become operative until engine parts begin relative movement, but premature wear of less-critical engine elements is still a problem.

Another approach, exemplified by U.S. Pat. No. 3,045,420, involves the use of a plurality of oil pumps, each supplying oil to separate engine lubrication systems. The pump, which supplies oil to the turbocharger unit of the engine, is actuated prior to combustion, continues to operate during engine operation, and operates for a brief period after engine shutdown to protect the relatively sensitive high speed turbocharger bearings. This system may be beneficial in extending the turbocharger life expectancy, but it does not protect other vital engine components, it introduces substantial complexity into the lubrication system of the engine, and failure of the turbocharger pump would lead to turbocharger failure within seconds.

In still another approach as exemplified in U.S. Pat. No. 4,502,431, oil is pumped within the engine passageways prior to cranking for a period sufficient to provide an operational oil pressure level before any engine parts begin to move. In this manner, all bearing surfaces are fully lubricated in advance of their load-bearing operation and life expectancy is substantially increased. This result is accomplished by providing a supplemental oil pump which is driven from the starter motor armature shaft of the diesel engine. When the starter switch of the internal combustion engine is engaged, an electrical impulse is first provided to initiate the rotation of the starter motor armature shaft to drive the supplemental oil pump, thereby bringing oil pressure up to operational levels before the initiation of actual engine cranking. When the starter motor is actuated to turn the crankshaft to initiate combustion, both the main and supplemental oil pumps become operative. As the starter motor automatically disengages and is de-energized upon combustion, the supplemental oil pump stops. A main oil pump that is smaller and less expensive than normally utilized is sufficient to maintain the already-established oil pressure.

Finally, manufacturers of internal combustion engines are known to attempt to minimize the problem of premature engine component wear by incorporating relatively large capacity oil pumps in the lubricating system in order to minimize the period between initial combustion and when engine oil pressure reaches its normal operating level. These latter approaches have not had the desired result of optimally reducing wear, and they have caused the undesirable effects of introducing unnecessary weight, size, complexity and expense to the engine and auxiliary assemblies.

It has been found that the extensive and premature wear of internal combustion engines is due to factors which include inadequate start-up lubrication. The problem of premature wear has been correlated to the time the engine is not used, the lubricity of the oil and the tenacity of its adhesion to bearing surfaces. In the conventional internal combustion engines, the oil pump mechanism is driven by gears from the crankshaft. Thus, oil is not directly provided to engine parts until after such parts have begun moving. Depending upon the size of the engine and the capacity of the pumping mechanism, normal operating oil pressure is normally not obtained in the system for five or more seconds after cranking begins. Only residual oil remaining on the bearing surfaces from the previous operation provides lubrication and protection until a new supply of oil is provided by the pump. Newer high lubricity oils increase the fuel economy of the engine, but they also tend to promote start-up wear when engines are not operated for periods of time. Such oils tend to lack adhesion tenacity and leave minimal residual oil on bearing surfaces when an engine is not in use, resulting in bearings being left relatively unlubricated during the initial start-up period. The present invention provides a relatively simple and effective mechanism to extend the life of the bearing surfaces of an internal combustion engine, by assuring that an adequate oil supply is provided to the bearing surfaces before any relative movement of engine parts occurs.

In reference to water storage tanks and other pressurized tanks and containers which utilize gas as a pressure and force producing mechanism, the present invention solves the problem of reduction in pressure as tank contents are depleted by the use of a liquid which undergoes a phase change to a gas at the pressure at which the contents are to be expelled. The present invention provides for the use of a liquid which undergoes a phase change to a gas at the pressure at which the contents are expelled. This liquid or gas, depending on the phase may be constrained in the tank by means of a collapsible bag or number of bags placed within the tank or container, or may be partitioned within the tank and separated form the tank contents by means of a flexible and/or elastic membrane.

In reference to a oil accumulator, the present invention solves the above problems by providing a captive bag in an accumulator tank to accumulate and release oil for engine lubrication prior to combustion. The bag is filled with air or an easily condensed gas which undergoes compression as the oil is accumulated in the accumulator tank to provide the pressure source for forcing the oil into the engine to initiate the pre-combustion lubrication process. Because of the use of a captive bag, the oil is kept isolated from the air or easily condensed gas allowing the accumulator tank to be placed in any position as is necessary to prevent air loss with accumulators not having a oil isolation mechanism. Further, the captive bag technique prevents any absorption or chemical interaction between the oil and the gas, and also minimizes or eliminates air leakage which would ultimately incapacitate the accumulator function. Finally, the captive air bag is easier to replace than conventional membranes which could be used to accomplish the same function.

Because of the use of an easily condensed gas undergoing a phase change in the preferred embodiment, the overall size of the accumulator is minimized to only that volume of oil needed for pre-oiling plus a minor volume for the bag material and the condensed liquid, thus substantially reducing the overall volume of the tank necessary for subsequent pre-ignition oiling. Further the use of an easily condensed gas rather than air allows the oil pressure delivered by the pre-ignition oiler to be relatively constant since it will be determined by the essentially constant vapor pressure of the gas at pre-oiling temperatures rather than the wide variations in air pressure which would be encountered with the use of accumulators utilizing air as oil is released from the tank.

Accordingly, it is an object of the present invention to provide an apparatus to accumulate and release oil for engine lubrication prior to combustion.

It is another object of the present invention to provide an apparatus to accumulate and release oil for engine lubrication prior to combustion which is filled with air or an easily condensed gas which undergoes compression as the engine lubricating material is accumulated in the accumulator tank to thereby provide the pressure source for forcing the engine lubricating material into the engine to initiate the pre-combustion lubrication process.

It is another object of the present invention to provide a captive bag in an accumulator tank to accumulate and release oil for engine lubrication prior to combustion which minimizes air leakage and prevents any absorption or chemical interaction between the engine lubricating material and the pressure source material.

It is another object of the present invention to provide an apparatus to accumulate and release oil for engine lubrication prior to combustion which utilizes an easily condensed gas which undergoes a phase change from a gaseous state to a liquified state as the engine lubricating material is accumulated and which undergoes a phase change from a liquified state to a gaseous state as the engine lubricating material is released into the engine.

It is another object of the present invention to provide an apparatus to accumulate and release oil for engine lubrication prior to combustion which utilizes an easily condensed gas that provides a substantially constant pressure to deliver the engine lubricating material to the engine.

It is another object of the present invention to provide a captive bag in an accumulator tank to accumulate and release oil for engine lubrication prior to combustion which substantially reduces the overall volume of the accumulator necessary for use in pre-combustion engine lubrication.

It is another object of the present invention to provide a captive bag to accumulate and release oil for engine lubrication prior to combustion which improves the ease of maintenance and repair of the engine lubrication system.

It is another object of the present invention to provide a means of enhancing the volume of oil delivered by the accumulator.

It is another object of the present invention to provide an apparatus to accumulate and release fluids or fluid like materials.

It is another object of the present invention to provide an apparatus to accumulate and release fluids or fluid-like materials which is filled with an easily condensed gas which undergoes compression as the fluid or fluid-like material is accumulated in a storage tank to thereby provide the pressure source for expelling or dispensing the fluid or fluid-like material.

It is another object of the present invention to provide a captive bag or partitioned volume in a storage tank or container to accumulate and release fluid or fluid-like material which minimizes gas leakage and prevents any absorption or chemical interaction between the fluid or fluid-like material and the pressure source material or release of the pressure source material.

It is another object of the present invention to provide an apparatus to accumulate and release fluid or fluid-like material which utilizes an easily condensed gas which undergoes a phase change from a gaseous state to a liquified state as the fluid or fluid-like material is stored and which undergoes a phase change from a liquified state to a gaseous state as fluid or fluid-like material is expelled or dispensed.

It is another object of the present invention to provide an apparatus to store and release fluid or fluid-like material which utilizes an easily condensed gas that provides a substantially constant pressure to dispense the fluid or fluid-like material.

It is another object of the present invention to provide a captive bag or bags or partitioned volume within a storage tank or container to store and dispense fluid or fluid-like material which substantially reduces the overall volume of the storage tank or container necessary for use in storing or dispensing fluid or fluid-like material.

It is another object of the present invention to provide a captive bag or flexible and/or elastic container containing an easily condensed gas such that said captive bag or flexible and/or elastic container may be inserted into a tank or other container to provide a means of storing a fluid or fluid-like material within said tank or other container under a pressure which substantially the same or greater than the pressure at which said gas is condensed into a liquid.

It is another object of the present invention to provide a means of enhancing the volume of a fluid or fluid-like material contained within a storage tank or container.

SUMMARY OF THE INVENTION

According to the present invention, a pre-ignition engine lubrication accumulator tank is provided with a collapsible bag made of a suitable polymer or other flexible, non-permeable material containing either air or an easily condensed gas such as one of the freons, butane, butadiene, butene, ammonia or other flourocarbons, flouro-hydrocarbons, flouro-chloro-hydrocarbons, and other easily condensed gases. Appropriate valving known in the state-of-the-art allows a lubricating material such as oil or a synthetic polymer suitable for engine lubrication to be accumulated in the tank under pressure during normal engine operation due to the operation of a conventional engine oil pump.

The pressurized oil causes the air or gas in the bag to become compressed. In the case of the bag containing air, the bag would decrease in occupied volume in proportion to the pressure induced by the oil to allow the oil to occupy a suitable portion of the tank. In the preferred embodiment of the invention, the pressurized oil would cause the gas to undergo a phase change and liquify to allow the bag to substantially decrease in occupied volume. Ultimately the volume of the bag will decrease to only that necessary for the bag material and the liquified gas, permitting the oil to occupy all but a minor portion of the accumulator tank. Conventional valving known in the-state-of-the-art is provided to allow the accumulated pressurized oil to be used prior to a subsequent engine startup, and conventional electronic control systems are provided to engage and disengage the aforementioned valves for a proper pre-oiling sequence.

In addition, in those cases where a large amount of oil is needed to complete the prelubrication process and/or a limited amount of space is available for the accumulator tank, a volume enhancer may be utilized with the present invention. The volume enhancer permits injection of oil from the accumulator into an engine oil line at sufficient velocity to transfer momentum to the oil within the oil line so as to cause injection of additional oil into the engine, causing a net increase in the total amount of oil supplied to the engine by the prelubrication system.

Also according to the present invention, a storage tank or container is provided with a collapsible bag or a membrane made of a suitable polymer or other flexible, non-permeable material containing an easily condensed gas such as one of the freons, butane, butadiene, butene, ammonia or other flourocarbons, flouro-hydrocarbons, flouro-chloro-hydrocarbons, and other easily condensed gases or in the case where high pressure is desired, carbon dioxide or other such gases. Appropriate means known in the state-of-the-art allows a fluid or fluid-like material to be accumulated in the tank under pressure during normal storage.

The pressurized fluid or fluid-like material being forced into the tank or container causes gas in the bag to become compressed. In the preferred embodiment of the invention, the pressurized fluid or fluid-like material would cause the gas to undergo a phase change and liquify to allow the bag to substantially decrease in occupied volume. Ultimately the volume of the bag will decrease to only that necessary for the bag material and the liquified gas, permitting the oil to occupy all but a minor portion of the accumulator tank. Conventional means known in the-state-of-the-art is provided to allow the accumulated pressurized fluid or fluid-like material to be dispensed.

Also according to the present invention a partition consisting of a flexible and/or elastic membrane could be placed within the tank to provide a chamber for the easily condensed gas instead of the use of a bag.

Also according to the present invention a elastic or flexible container filled with easily condensed gas could be utilized within a conventional container combined with appropriate means to render said container capable of storing and dispensing fluid or fluid-like material under pressure.

Other details, objects, and advantages of the present invention will become apparent in the following description of the presently preferred embodiments.

BRIEF DESCRIPTION OF THE DETAILED DRAWINGS

DETAILED DESCRIPTION OF THE PRESENTLY PREFERRED EMBODIMENTS

Figure 1:
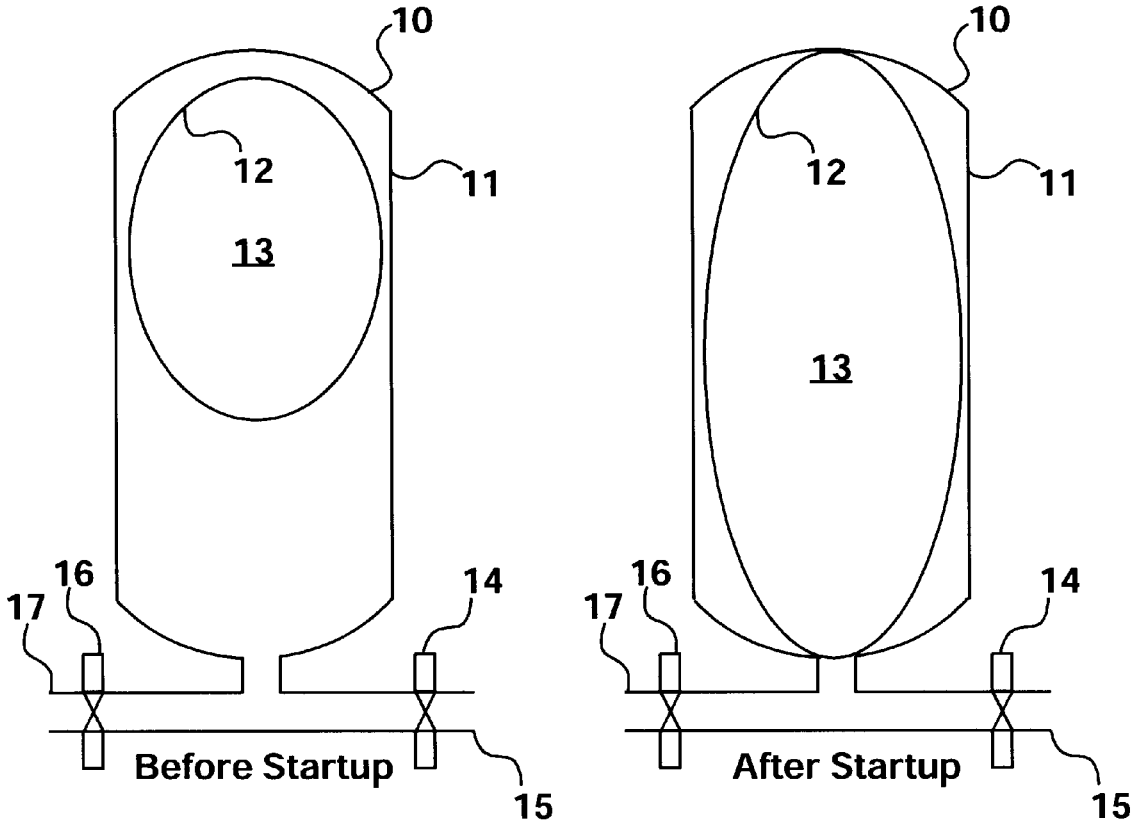
FIG. 1 is a side view of the present invention showing the features of the present invention using air, both before and immediately after the start-up mode.

With reference to FIG. 1, there is shown a pressure tank 10 of a preferred embodiment of the present invention. Generally, the pressurized tank 10 includes a housing 11 which is shown as a cylinder but may be any shape as dictated by space requirements or cosmetic appearance. Within the housing 11 is one or more collapsible containers 12, which may be bags or volumes within housing 11 partitioned by means of flexible and/or elastic membranes, made of any polymer or other flexible non-permeable material known in the state-of-the-art which permits a decrease in volume as the contents of the container become pressurized. With reference to FIG. 1, confmed within the container 12 is air or another gas 13 which is not easily condensed at normal engine operating temperatures. Such gases typically include nitrogen, argon and carbon dioxide. Inlet valve 14 is electrically or mechanically activated to allow the inlet of a combustion engine lubrication material such as oil or a synthetic material or combinations thereof suitable for engine lubrication from a line 15 which is connected to the lubrication system of the internal combustion engine. Similarly, outlet valve 16 is electrically or mechanically activated to allow the outlet of oil from the accumulator 10 to a line 17 which is connected to the lubrication system of the internal combustion engine to provide lubrication to the internal combustion engine prior to the initiation of combustion.

During normal engine operation inlet valve 14 is open while outlet valve 16 is closed to permit the inlet of pressurized oil from the combustion engine lubrication system through valve 14. The accumulation of oil in the housing 11 causes the air or gas in the bag 12 to become compressed thereby causing the container 12 to decrease in occupied volume in proportion to the amount of oil accumulated in the housing 11. Upon a subsequent start-up of the engine and prior to the initiation of combustion, outlet valve 16 is opened to permit the release of accumulated oil from the housing 11 to the engine lubrication system under the force of the compressed air or gas in the container 12.

Figure 2:
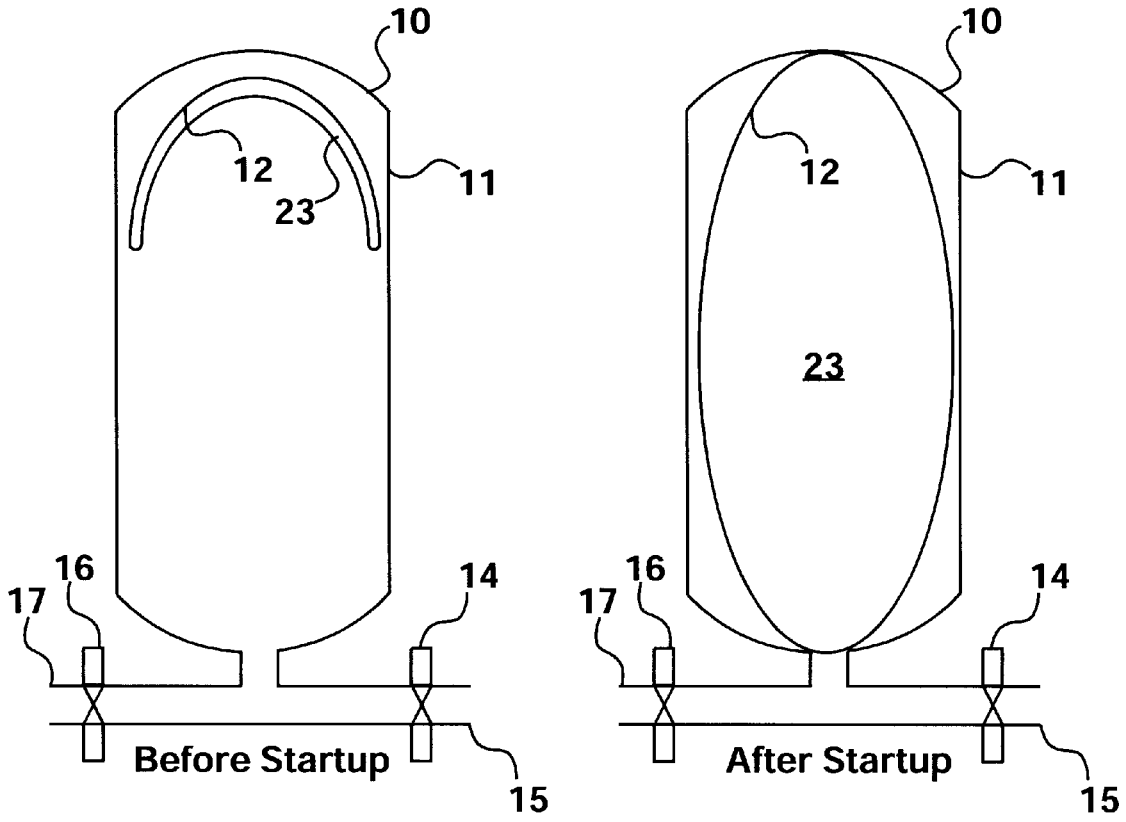
FIG. 2 is a side view of the present invention showing the features of the present invention using an easily condensed gas, both before and immediately after the start-up mode

With reference to FIG. 2, there is shown an accumulator 10 of another preferred embodiment of the present invention. Generally, the accumulator 10 includes a container 11 and bag 12, inlet valve 15 and outlet valve 16 as described above. Confmed within the container 12 is a gas 23 which is easily condensed at normal operating temperatures normal operating temperatures of the device incorporating this pressurized tank 10, such as but not limited to one of the freons, butane, butadiene, butene, ammonia or other flourocarbons, flouro-hydrocarbons, flouro-chloro-hydrocarbons, and other easily condensed gases. Inlet valve 14 is electrically or mechanically activated to allow the inlet of a fluid or fluid-like material such as water, or fluid-like material, or oil from a line 15 which is connected a fluid pump system such as a well water pump. Similarly, outlet valve 16 is electrically or mechanically activated to allow the fluid from the pressurized tank 10 to a line 17 which is connected to a dispensing system such as the plumbing system of a house.

During normal operation the inlet of pressurized fluid from a inlet system through valve 14 causes the gas 23 in the container 12 to become compressed, which in the case of an easily condensed gas will cause the gas to undergo a phase change from a gaseous to a liquified state, causing the container 12 to substantially decrease in occupied volume. Ultimately the volume of the container 12 will decrease to only that necessary for the container 12 material and the liquified gas 23, thereby permitting the fluid to occupy all but a minor portion of the housing 11. Outlet valve 16 is opened to permit the release of accumulated fluid from the housing 11 to the outlet system under the force of the liquified gas 23 in the container 12, which will expand and undergo the reverse phase change from a liquid to a gas to supply the force to allow release of the accumulated fluid from the housing 11 into the outlet system. The pressure delivered by the easily condensed gas 23 will be relatively constant as the fluid or fluid-like material is dispensed or expelled from pressurized tank 10 since it will be determined by the essentially constant vapor pressure of the gas. In certain cases where the ambient temperature is low enough, the energy required to cause the phase change of the easily condensed gas from a liquid to a gas may consume enough heat from the gas to cause the gas to freeze and/or liquify very slowly. To prevent such a problem from occurring, it may be necessary to provide one or more heaters or compressors with the apparatus 10 in order to heat the easily condensed gas 23 in low temperature environments.

With the assumed general appreciation of conventional internal combustion engine electrical systems, and with continued reference to FIG. 1, the pressurized tank 10, acting as an accumulator, is incorporated into the starting system of a combustion engine, such as that described in U.S. Pat. No. 4,502,431 and U.S. patent application Ser. No. 08/583,977 (the disclosures of which are incorporated herein by reference) for a time to allow the release of pressurized oil from the pressurized tank 10 to lubricate the internal combustion engine prior to the start-up of the engine. With start-up the inlet valve 14 to the accumulator is activated and allows refilling of oil to the accumulator in parallel with the continuous maintenance of lubrication to the engine. At a designated pressure the inlet valve 14 is closed and conventional lubrication of the engine takes causing the accumulator to be reset for the next start-up operation.

Figure 3:
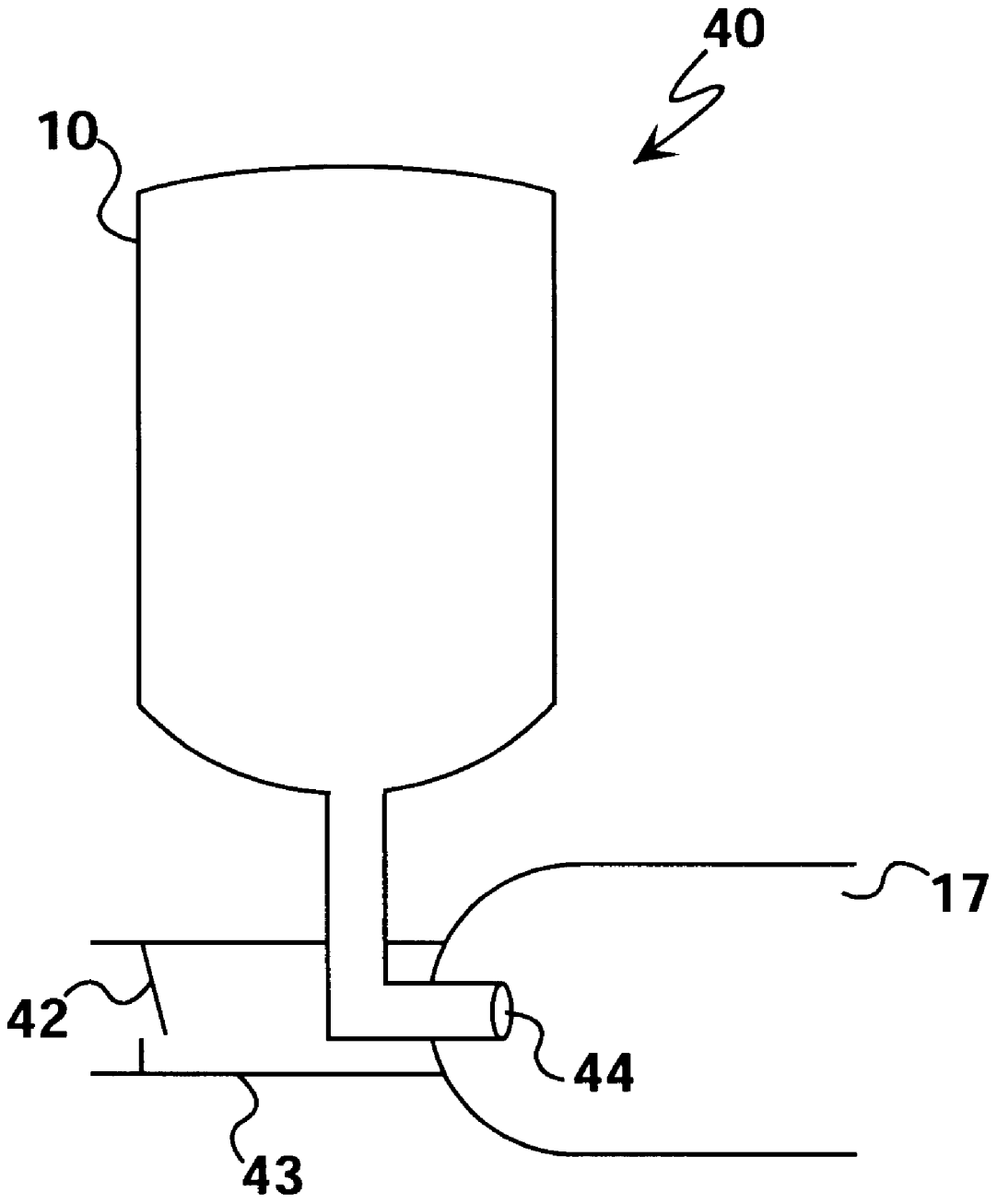
FIG. 3 is a side view of an embodiment of the present invention that incorporates the oil volume enhancer device.

Referring to FIG. 3, an oil volume enhancing mechanism 40 may be incorporated in the accumulator apparatus, the pressurized tank 10, of the present invention. The oil volume enhancing mechanism 40 is comprised of an injector 44 (similar in principle to a venturi tube) which injects oil from the accumulator 10 into the accumulator outlet line 17 which delivers the oil to the engine. The volume of the injector 44 is reduced from that of outlet line 17 so as to cause the oil to be injected into the engine at a higher velocity than when the accumulator 10 is used alone. This higher velocity causes the oil to collide with oil contained in the line 43 leading from the engine sump so as to encourage the sump oil from the engine sump into the engine. An anti-backup device 42 such as a check valve prevents the oil in line 43 from being reverse injected into the sump. Because of this interaction the total volume of the oil delivered to the engine will be greater than the volume of oil which could be supplied by the accumulator 10 alone. This permits the accumulator 10 to be reduced in size when compared to an accumulator not incorporating the volume enhancing mechanism 40.

Figure 4:
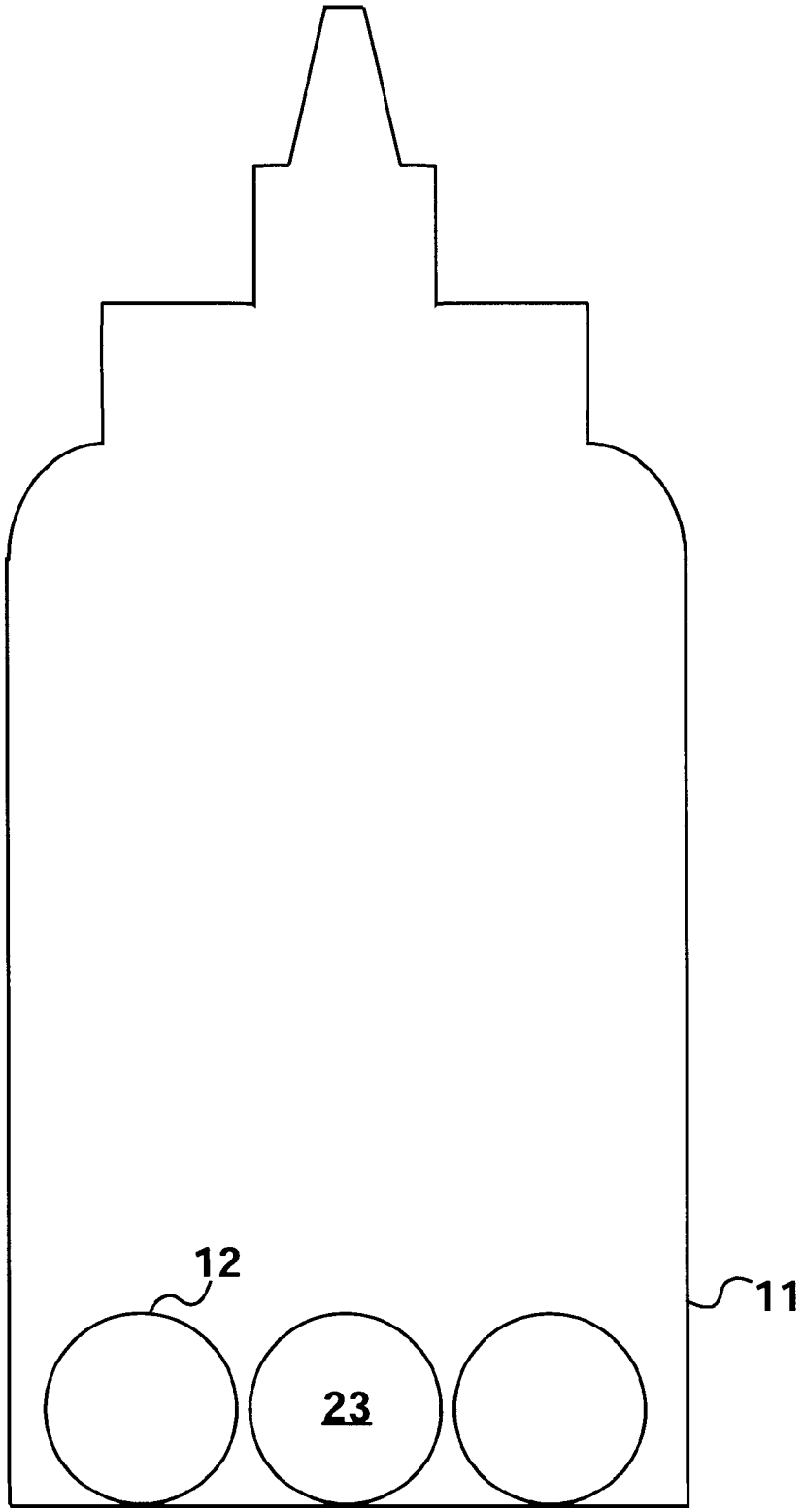
FIG. 4 is a side view of an embodiment of the present invention showing polymeric hollow or foam filled balls containing a condensed gas for use in releasing the contents of a pressurized container.

Referring to FIG. 4, it is also contemplated and within the scope of this invention that the flexible bags or membranes 12 themselves, containing an easily condensed gas 23, can be used by inserting them into appropriate container 11 which also incorporates appropriate valving or other means for introduction, sealing and dispensing of a fluid or fluid-like material into and out of the container 11. The flexible membranes 12 could be in the form of polymeric hollow or foam filled balls which would incorporate the easily condensed gas during manufacture, such as by conventional blow molding or rotational molding techniques. Such membranes 12 could also be in the form of flexible polymeric hollow balls conventionally manufactured such as by blow molding or rotational molding techniques and fitted with a valve or valves to replenish the gas 23. Such balls 12 could be used to ensure the controlled pressurized release of the contents of water bottles, paint cans, foodstuff dispensers and other fluid-like material dispensers. In such cases, the inlet of a pressurized fluid into the container 11 causes the easily condensed gas 23 in the membranes 12 to become compressed, thereby undergoing a phase change from a gaseous to a liquified state, causing the membrane 12 to substantially decrease in occupied volume to ultimately only that necessary for the membrane 12 material and the liquified gas 23, thereby permitting the fluid to occupy all but a minor portion of the container 11. Upon release of the accumulated fluid from the container 11 under the force of the liquified gas 23, the membrane 12 will expand causing the liquified gas 23 to undergo the reverse phase change from a liquid to a gas to supply the force to allow release of the accumulated fluid from the container 11. The pressure delivered by the easily condensed gas 23 will be relatively constant as the fluid or fluid-like material is dispensed or expelled from the container 11 since it will be determined by the essentially constant vapor pressure of the gas. In certain cases where the ambient temperature is low enough, the energy required to cause the phase change of the easily condensed gas from a liquid to a gas may consume enough heat from the gas to cause the gas to freeze and/or liquify very slowly. To prevent such a problem from occurring, it may be necessary to provide one or more heaters or compressors in order to heat the easily condensed gas 23 in low temperature environments.

While the present invention has been described in relation to internal combustion engines where it and epressurized storage tanks where it is particularly beneficial, it is recognized that the invention is also useful in a wide variety of other types of applications. For example, use of the invention in gas turbine applications is contemplated wherein suitable modifications as would be obvious to those skilled in the art of turbines could be made. The invention could also be used in conjunction with other types of pressurized storage tanks, such as water tans, water heaters, or deep or shallow well pump storage tanks to provide a source of pressure for releasing the fluids contained in such tanks to the systems in which they are used.

Accordingly, the present invention is not intended to be limited in scope by the description of the preferred embodiment provided above, but rather, only by the claims which follow.

What is claimed is:

1. An apparatus for permitting the accumulation and pressurized release of a fluidized material to a system utilizing said material, comprising:

A. a housing for storing said fluidized material and at least one material other than air used to generate the source of said pressure;

B. a means for releasing said fluidized material from said housing into said system under pressure from said pressure source material to permit said system to utilize said material wherein the accumulation of said fluidized material in said housing causes said pressure source material to undergo compression to increase the pressure available for releasing said fluidized material into said system, and wherein said pressure source material is an easily condensed gas which undergoes a phase change from a gaseous state to a liquified state as said material is accumulated in said housing and which undergoes a phase change from a liquified state to a gaseous state as said material is released from said housing.

2. The apparatus of claim 1, further comprising a means for supplying said fluidized material from said system to said housing to permit said fluidized material to be accumulated in said housing.

3. The apparatus of claim 2, wherein said means for supplying said lubricating material from said engine is electrically actuated.

4. The apparatus of claim 3, wherein said means for supplying said lubricating material comprises an electrical switch activated by an electrical control system.

5. The apparatus of claim 4, wherein said switch is selected from the group consisting of a timing switch and a pressure switch.

6. The apparatus of claim 2, wherein said means for supplying said lubricating material from said engine is mechanically actuated.

7. The apparatus of claim 6, wherein said means for supplying said lubricating material comprises at least one valve.

8. The apparatus of claim 2, wherein said means for supplying said lubricating material from said engine is electrically and mechanically actuated.

9. The apparatus of claim 8, wherein said means for supplying said lubricating material comprises at least one valve activated by an electrical control system.

10. The apparatus of claim 2, wherein said pressure source material is stored in at least one flexible container which collapses and expands to permit introduction and release of a fluidized material from a system comprising the environment external to said housing.

11. The apparatus of claim 10, wherein said means for supplying said fluidized material comprises means for transferring said fluidized material from said environment.

12. The apparatus of claim 11, wherein said means for releasing said fluidized material comprises means for removably sealing said fluidized material within said container.

13. The apparatus of claim 12, wherein said housing is selected from the group consisting of beverage containers, paint containers and foodstuff dispensers.

14. The apparatus of claim 10, wherein said flexible container is made of a nonpermeable material.

15. The apparatus of claim 10, wherein said flexible container is selected from the group consisting of a membrane and at least one collapsible ball.

16. The apparatus of claim 1, wherein said fluidized material is selected from the group consisting of oil, water, a water-based fluid, and a synthetic material.

17. The apparatus of claim 1, wherein at least one said material other than air comprises a compressible gas.

18. The apparatus of claim 17, wherein said compressible gas is selected from the group consisting of nitrogen, argon, carbon dioxide, or any other nonoxidizing gas.

19. The apparatus of claim 1, wherein said easily condensed gas is selected from the group consisting of freon, butane, butadiene, butene, ammonia, a fluorocarbon, a fluoro-hydrocarbon or a fluoro-chloro-hydrocarbon.

20. The apparatus of claim 1, wherein said easily condensed gas provides a substantially constant pressure to release said lubricating material from said housing.

21. The apparatus of claim 1, wherein said pressure source material is stored in at least one flexible container which decreases in volume as said lubricating material is accumulated in said housing.

22. The apparatus of claim 21, wherein said flexible container is made of a nonpermeable material.

23. The apparatus of claim 21, wherein said flexible container is selected from the group consisting of a membrane and a collapsible bag.

24. The apparatus of claim 1, wherein said means for releasing said lubricating material from said engine is electrically actuated.

25. The apparatus of claim 24, wherein said means of for releasing said lubricating material comprises an electrical switch activated by an electrical control system.

26. The apparatus of claim 25, wherein said switch is selected from the group consisting of a timing switch and a pressure switch.

27. The apparatus of claim 1, wherein said means for releasing said lubricating material from said engine is mechanically actuated.

28. The apparatus of claim 27, wherein said means for releasing said lubricating material comprises at least one valve.

29. The apparatus of claim 1, wherein said means for releasing said lubricating material from said engine is electrically and mechanically actuated.

30. The apparatus of claim 29, wherein said means for releasing said lubricating material comprises at least one valve activated by an electrical control system.

31. The apparatus of claim 1, further comprising at least one heat source for heating said easily condensed gas as said gas undergoes a phase change from said liquified state to said gaseous state.

32. The apparatus of claim 1, wherein said system is selected from the group consisting of a gasoline-powered engine, a diesel-powered engine, and a gas turbine engine.

33. The apparatus of claim 1, wherein said system comprises a pressurized storage tank.

34. The apparatus of claim 33, wherein said storage tank is selected from the group consisting of a water tank, a water heater, a deep well pump storage tank, and a shallow well pump storage tank.

35. The apparatus of claim 1, wherein said apparatus contains a mechanism for increasing the volume of the fluidized material supplied to said system by said apparatus.

36. The apparatus of claim 35, wherein said mechanism comprises an injection device for increasing the velocity of said fluidized material as it is released from said apparatus.

37. The apparatus of claim 36, wherein said mechanism further comprises an anti-backup device for preventing said fluidized material from flowing in a direction opposite that permitted by said releasing means.

38. The apparatus of claim 37, wherein said anti-backup device comprises a check valve.

39. The apparatus of claim 1, wherein said system comprises means for lubricating an engine.

* * * * *